US011065908B2

(12) United States Patent
Schorr, III

(10) Patent No.: US 11,065,908 B2
(45) Date of Patent: Jul. 20, 2021

(54) EXTENDABLE HAND-HELD DRY-ERASE SIGN

(71) Applicant: Jerome Otto Schorr, III, Bel Air, MD (US)

(72) Inventor: Jerome Otto Schorr, III, Bel Air, MD (US)

( * ) Notice: Subject to any disclaimer, the term of this patent is extended or adjusted under 35 U.S.C. 154(b) by 523 days.

(21) Appl. No.: 16/144,259

(22) Filed: Sep. 27, 2018

(65) Prior Publication Data

US 2019/0092087 A1 Mar. 28, 2019

Related U.S. Application Data

(60) Provisional application No. 62/563,801, filed on Sep. 27, 2017.

(51) Int. Cl.

| | |
|---|---|
| ***B43L 1/00*** | (2006.01) |
| ***B43L 3/00*** | (2006.01) |
| ***G09F 21/02*** | (2006.01) |
| ***G09F 19/00*** | (2006.01) |

(52) U.S. Cl.

CPC ..... *B43L 1/00* (2013.01); *B43L 3/008* (2013.01); *G09F 19/00* (2013.01); *G09F 21/02* (2013.01); *Y10T 428/24215* (2015.01); *Y10T 428/24231* (2015.01)

(58) Field of Classification Search

None

See application file for complete search history.

(56) References Cited

U.S. PATENT DOCUMENTS

| | | | |
|---|---|---|---|
| 6,666,424 | B2 | 12/2003 | Richardson |
| 7,635,052 | B2 | 12/2009 | Ceballos-Godefroy |
| 7,980,857 | B2 | 7/2011 | Cheris |
| 8,517,329 | B2 | 8/2013 | Nash |
| 8,591,131 | B2 | 11/2013 | Rhodes |

*Primary Examiner* — Alexander S Thomas

(74) *Attorney, Agent, or Firm* — Royal W. Craig; Gordon Feinblatt LLC

(57) ABSTRACT

An extendable dry-erase board with a telescoping hand-held support extension handle pivotally-connected at one end to an accordion-folding dry erase board. The device can be easily transported by those traveling via bus, bicycle, walking, etc. to any sporting event, concert, or public demonstration and deployed instantly on-site, the dry-erase board being unfolded into a large prominent sign whereupon a message can be inscribed on the board, erased and rewritten as needed.

20 Claims, 5 Drawing Sheets

EXTENDABLE HAND-HELD DRY-ERASE SIGN

CROSS-REFERENCE TO RELATED APPLICATION(S)

The present application derives priority from U.S. Provisional Patent Application 62/563,801 filed 27 Sep. 2017.

BACKGROUND OF THE INVENTION

1. Field of the Invention

The present invention relates generally to dry-erase signage, and more particularly to a dry-erase board configured to be foldable and portable, with an extendable hand-held support handle.

2. Description of the Background

Hand-held personal signs are commonly used during sporting events, concerts, acts of civil disobedience, protests, pickets, election campaigns, festivals, commercial advertising and/or the like to personalize messages the user wants to deliver. The conventional solution is to use a wooden stick or similar structure attached to a poster-board, cardboard, foam-board, corrugated plastic board or the like with the text and/or images permanently written on the board to create the desired message. A major drawback is that these devices all require the user to commit to an ineradicable message for the duration of their use of the large, ungainly board and stick structure. Yet another major drawback with these types of display boards is that they are not readily portable since they are comprised of assembled stick and board structures that cannot be easily folded without damaging the structure and/or appearance.

Dry-erase boards or "white boards" are commonly used in a wide variety of situations to provide easily modifiable surfaces for presentations, education, note taking, diagrams and the like. However, conventional dry-erase boards are primarily permanent or semi-permanent bulky installations that are meant to be placed on a wall, a table, or an easel for placement in a specific location. A major drawback with these types of display boards is that they are not collapsible enough that they can be stored in a small space, e.g., in a backpack, for transport to a sporting event. Yet another major drawback with these types of display boards is that they are somewhat heavy and are not designed to be hand-held for extended periods of time.

What is needed is a knock-down dry erase sign to allow persons attending a sporting event, concert, election campaign, act of civil disobedience, etc. to fold the dry-erase board into a portable compact structure that can be easily transported to the final destination.

There have been limited efforts to improve dry-erase boards for use outside of offices and classrooms. For example, U.S. Pat. No. 6,666,424 improves on the standard dry-erase board by creating a collapsible writing board structure with molded plastic panels and an incorporated tripod so that the structure can be transported to a location and placed as a transient display. U.S. Pat. No. 8,591,131 incorporates a clip into a permanent handle of a small dry-erase board so that a marker can be easily attached or detached from the frame. U.S. Pat. No. 7,635,052 creates a demountable writing board display that can be stored in the form of a briefcase for easier transport.

Other foldable dry-erase boards have also been introduced in U.S. Pat. Nos. 7,980,857 and 8,517,329 both configured so that the dry-erase board components fold into themselves for storage. As a result, these dry-erase boards provide varying amounts of collapsibility, but none of them provide an easily foldable and portable dry-erase board with an extendable hand-held support handle.

Thus, it would be greatly advantageous to provide a compact foldable dry-erase board system with an extendable hand-held support handle that can be easily transported by those traveling via bus, bicycle or walking to any sporting event, concert, election campaign, or other public gathering. Upon reaching said destination, the dry-erase board can be unfolded into a singular display board and the message can be inscribed on the board, erased and rewritten as needed. The handle connected to the dry-erase board can be unfolded and extended allowing the entire dry-erase board with the message to be extended above the head of the user for prominent display of the sign.

SUMMARY OF THE INVENTION

It is an object of the present invention to provide an extendable dry-erase board with an integral pivotally coupled telescoping support handle that can collapse in entirety into a compact portable sign display system.

It is another object of the present invention to provide an extendable dry-erase board with multiple accordion-style folding panels, each panel having a writing surface on one or both faces thereof.

It is still another object of the present invention to provide an extendable dry-erase board with integral pivotally coupled extendable support handle.

It is still another object of the present invention to have multiple folding panels, each panel having a chalk writing surface on one or both faces thereof.

It is still another object of the present invention to have multiple folding panels, each panel having a wet-erase writing surface on one or both faces thereof.

In accordance with the foregoing objects, the present invention is an extendable dry-erase board with a telescoping hand-held support extension handle pivotally-connected at one end to an accordion-folding dry erase board. An embodiment of the dry-erase board includes a writing board substrate of corrugated, fluted or similar plastic board comprising a front panel, one or more rear panels opposite the front panel, and a plurality of spaced apart ribs connecting the front panel to the rear panel(s), wherein the front panel and the rear panel(s) are integrally formed with the plurality of ribs. The writing board of this embodiment further includes at least one backslit formed in the rear panel, at least one living hinge formed in the front panel opposite the at least one backslit to form at least one outer panel, and at least one holding mechanism coupled to the at least one outer panel to maintain the outer panel in one of a substantially open, unfolded position or a substantially closed, folded position. In this embodiment, the plurality of ribs may be oriented in a widthwise direction, a lengthwise direction, both a widthwise direction and a lengthwise direction, or a diagonal direction of the substrate. The plurality of ribs may extend from a first end of the substrate to a second end of the substrate opposite the first end. The dry-erase board may further include a film or laminate affixed to at least one of the front or rear panels of the substrate, the film having a surface adapted to erasably receive writing thereon, wherein the film may be a polyester, a UV cured polyurethane, a polypropylene or similar material.

The device can be easily transported by those traveling via bus, bicycle, walking, etc. to any sporting event, concert, or public demonstration and deployed instantly on-site, the dry-erase board being unfolded into a large prominent sign whereupon a message can be inscribed on the board, erased and rewritten as needed.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is an extendable dry-erase board with a telescoping hand-held support handle pivotally-connected to an accordion-folding dry erase board that can be easily transported by those traveling via bus, bicycle, walking, etc. to any sporting event, concert, or public demonstration and deployed instantly on-site, the dry-erase board being unfolded into a large prominent sign whereupon a message can be inscribed on the board, erased and rewritten as needed.

Figure 1:
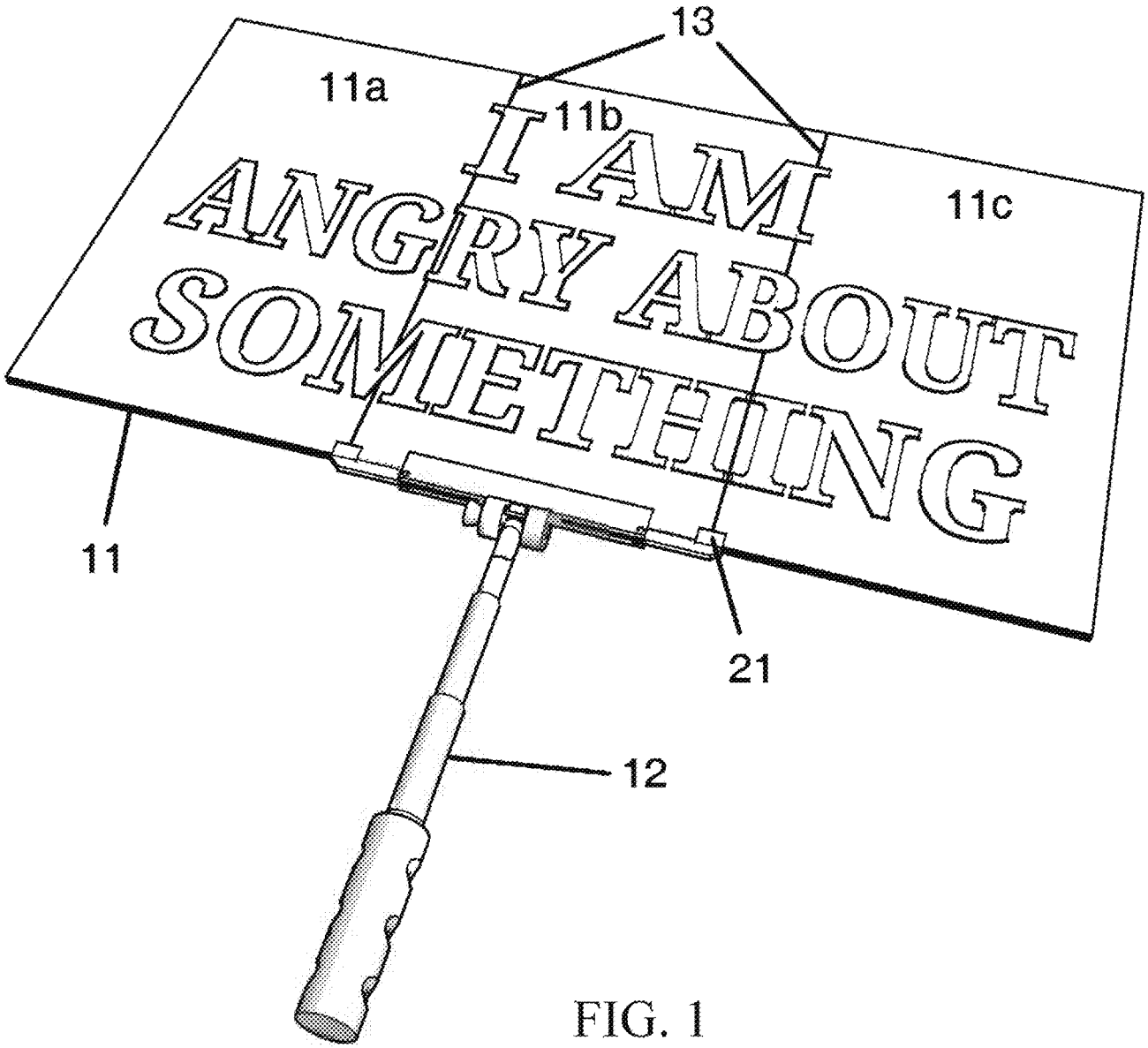
FIG. 1 shows a front perspective view of an embodiment of the fully open extendable hand-held dry-erase sign with the dry-erase board and telescoping handle extended in accordance with the preferred embodiment of the present invention.
Figure 2:
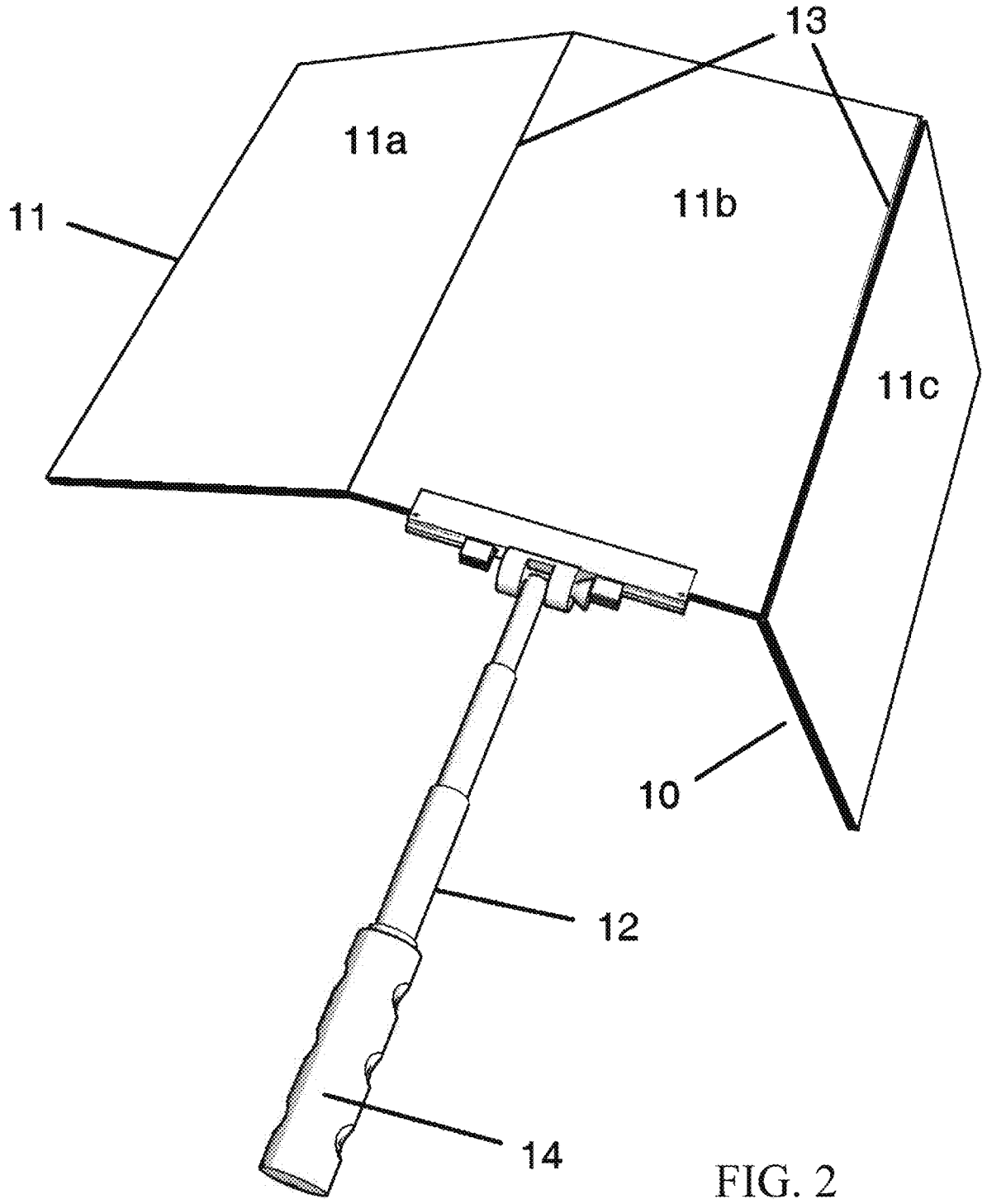
FIG. 2 shows a rear perspective view of the partially open extendable hand-held dry-erase sign of FIG. 1.

FIG. 1 shows the fully open front of an extendable hand-held dry-erase sign 10 according to an embodiment of the invention, and FIG. 2 a partially open rear view. With combined reference to FIGS. 1-2 the hand-held dry-erase sign 10 generally includes a dry-erase board 11 with a fully extended hand-held telescoping support handle 12. The support handle 12 includes a handgrip 14 at the base of the support handle. The dry-erase board 11 includes a plurality of panel sections 11*a*, 11*b*, 11*c* . . . 11*n* that are pivotally joined accordion-style along parallel flexible hinges 13, all shown unfolded and fully extended in the illustrated configuration of FIGS. 1-2. When the multiple panel sections 11*a*, 11*b*, 11*c* . . . 11*n* of the dry-erase board 11 are fully open, unfolded flat, they present a clean unbroken dry-erase surface for decoration by dry-erase or similar marking pen(s). The handle 12 connected to the dry-erase board 11 can be both unfolded and telescopically-extended to a deployed position allowing the entire dry-erase board 11 with any desired message or image to be extended above the head of the user for prominent display of the sign. When the panels are in the fully open co-planar position, they can be temporarily secured in place at the top and/or bottom of the flexible hinges 13 via the use of clips, clamps, brackets, lockable hinges, U-shaped flute channel locks, tape, hook-and-loop or similar holding mechanisms 21.

Figure 3:
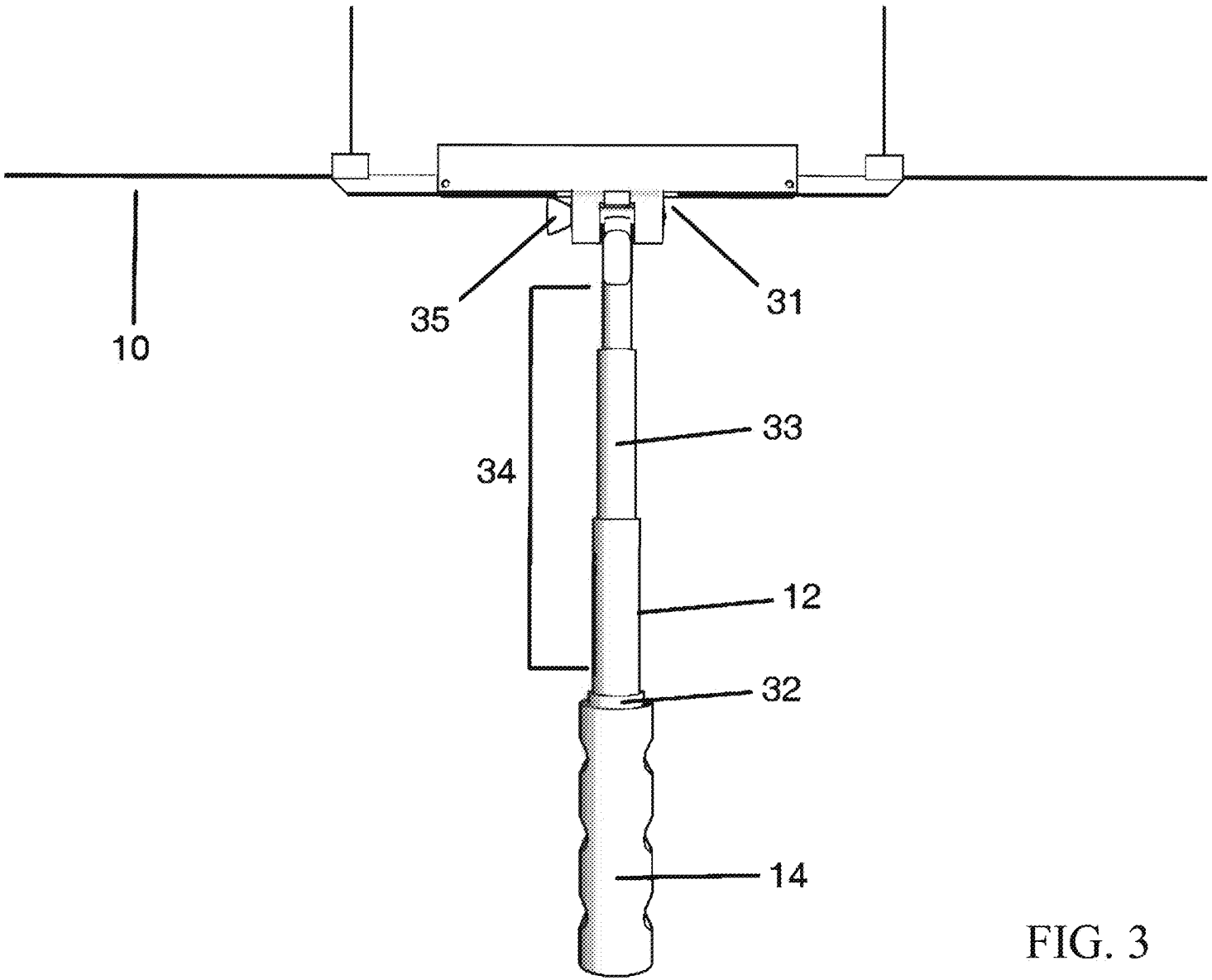
FIG. 3 shows an enlarged front perspective view of the telescoping handle component.

FIG. 3 shows a partial rear view of the extendable hand-held dry-erase sign 10 including a pivot assembly 31 to which the elongated support handle 12 is integrally secured. The elongated support handle 12 is of a telescoping construction with multiple coaxial segments of reducing diameter slidably inserted into each other. To this end, the elongated support handle 12 includes a first large diameter hollow cylindrical segment 32 which is partially encased by a rubber handgrip 14, and a small diameter cylindrical segment 33 having a distal head with transverse hole carried by the pivot assembly 31, plus any number of intermediate cylindrical segments 34 as a matter of design choice. Pivot assembly 31 comprises a yoke 37 with a pair of spaced collars protruding from a spine 39 attached along a central panel 11*b*, and a pin 35 inserted through the yoke 37 and the transverse hole in the head of small diameter cylindrical segment 33.

When the handgrip 14 is moved away from the pivot assembly 31, the segments are telescoped to their extended position as illustrated. However, when moved in the opposite direction, the elongated support handle 12 compacts into its retracted position, and can be rotated on the pivot assembly 31 to a flush stowed configuration shown in FIG. 4. Moreover, the pivot assembly 31 can be locked at any intermediate orientation by tightening the locking knob of pin 35 as seen in FIGS. 3-4 to prevent pivoting.

Figure 4:
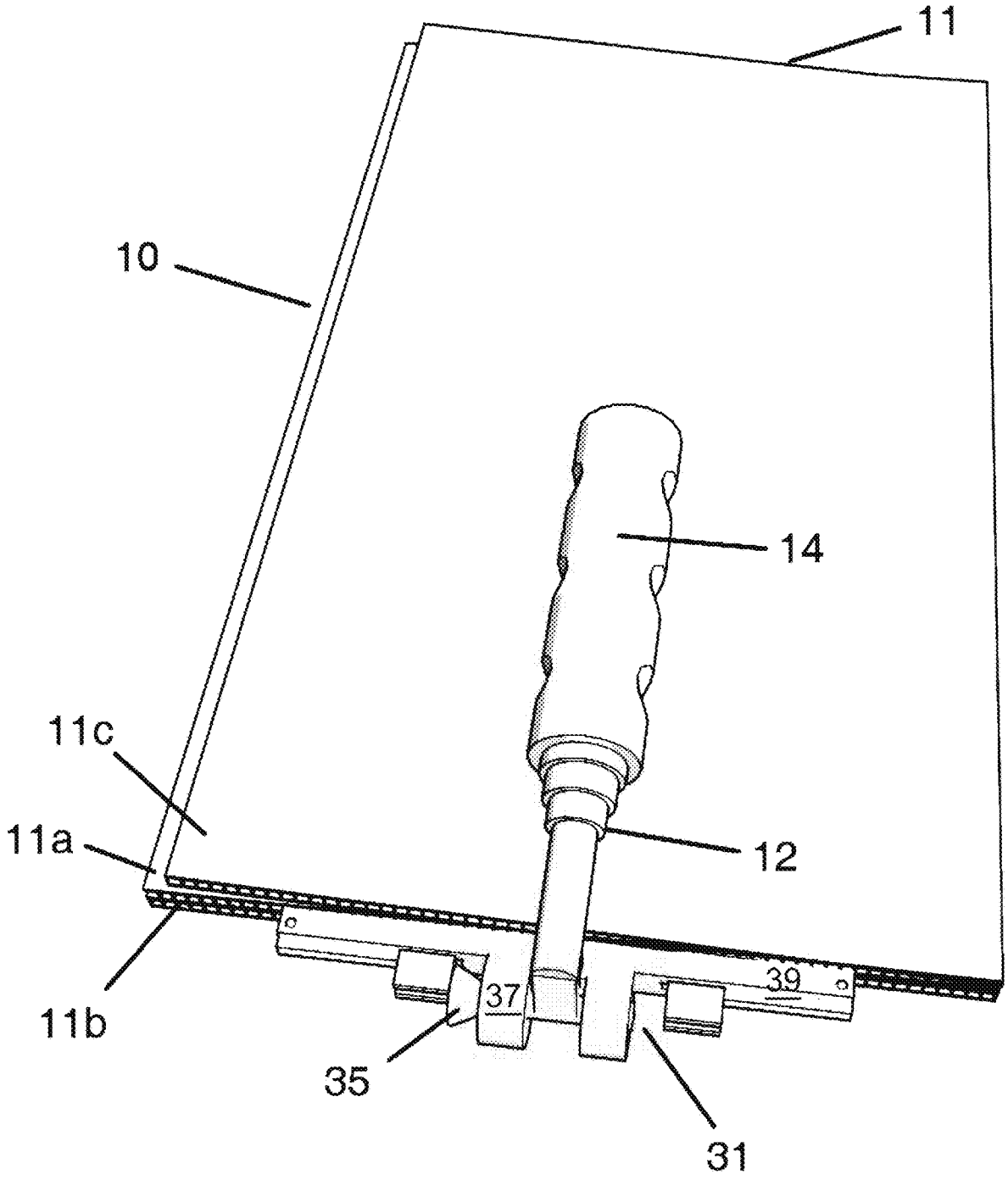
FIG. 4 shows a rear perspective view of the extendable hand-held dry-erase sign with all components folded and retracted.

FIG. 4 shows a rear view of the extendable hand-held dry-erase sign 10 in a compact configuration with the dry-erase board panel sections 11*a*, 11*b*, 11*c* and the support handle 12 fully retracted, including the support handle 12 pivoted to rest against the rear of the dry-erase board 11.

Figure 5:
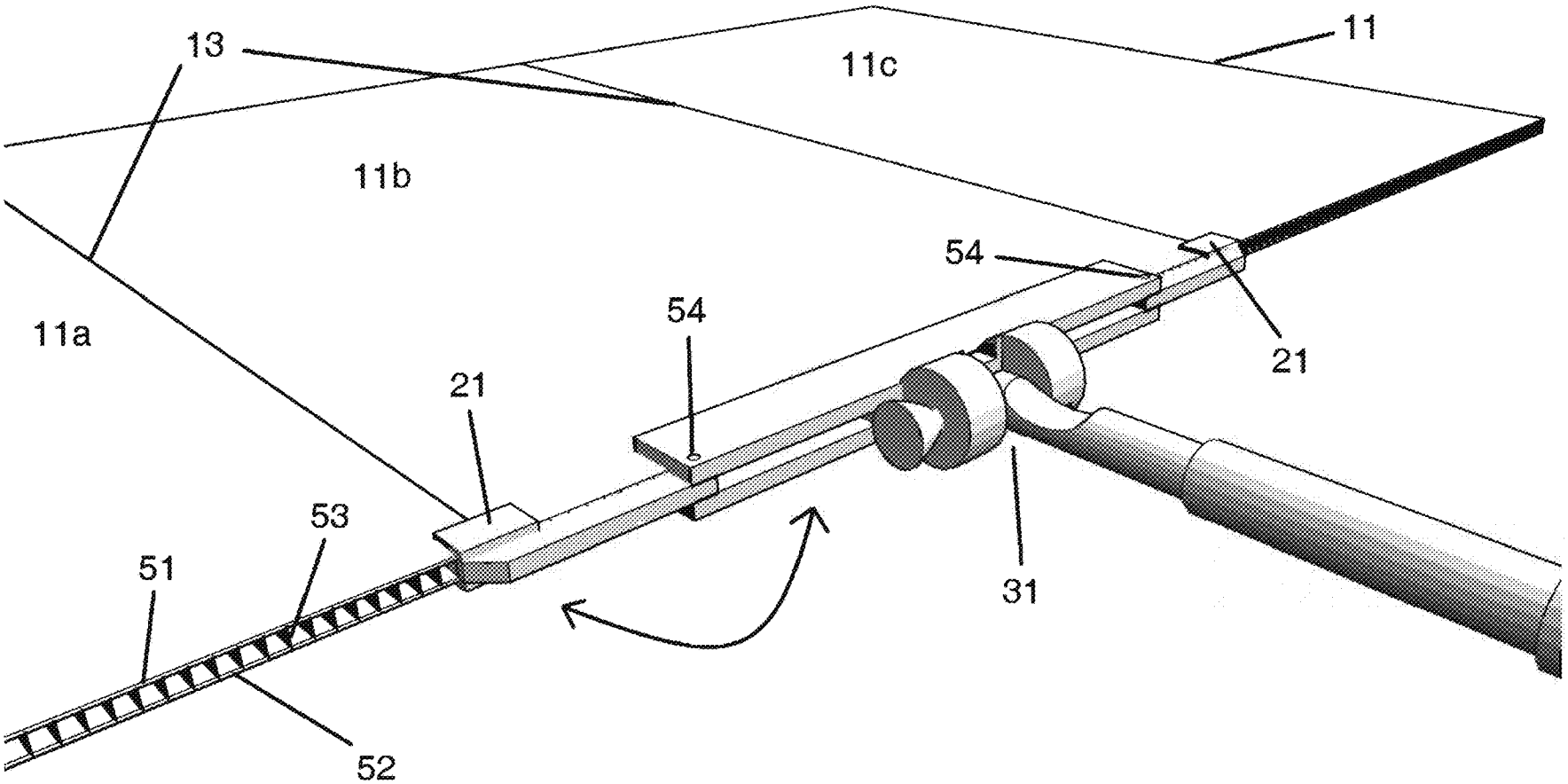
FIG. 5 shows a front perspective view of the corrugated plastic board and panel holding mechanism of the extendable hand-held dry-erase sign.

FIG. 5 shows a partial bottom perspective view of the dry-erase board 11 that may be formed from one or more unbroken panels of corrugated, fluted or similar extruded twinwall plastic sheets manufactured having a front face member 51 integrally and parallely formed with a rear face member 52, and joined together by a plurality of conjoined ribs 53. The dry-erase board 11 may include a film or laminate affixed across the front face member 51 to configure it to erasably receive writing thereon, wherein the film may be a polyester, a UV cured polyurethane, a polypropylene or similar material.

In a preferred embodiment the dry-erase board 11 is formed from a single unbroken panel of corrugated twinwall plastic as described above, but rear face member 52 is cut and front face member 51 is conformingly scored vertically at evenly-spaced offset intervals (but not cut), so as to define flexible hinges 13 that allow it be folded accordion-style and/or unfolded and extended allowing the entire dry-erase board 11 with the message to be extended above the head of the user for prominent display of the sign. The flexible hinges 13 allow the individual panels 11*a*, 11*b* . . . 11*n* to be pivotally coupled to one another to define an open position and a closed position. The open position situates the writing surface in a co-planar relationship to provide a continuous writing surface. The closed position situates the faces of each panel in a generally parallel relationship.

As seen in FIG. 5, the spine 39 includes a pair of pivotally-deployable arms 22, one at each end of spine 39 mounted by hinges 54. Each arm 22 carries a holding mechanism 21 at its deployable end, for example, a pair of resilient gripping fingers spaced for a friction-fit around dry-erase board 11 and positioned span a flexible hinge 13 to thereby impede folding when deployed. FIG. 5 shows this vis-à-vis dry-erase panel board sections 11*a*, 11*b*, 11*c* temporarily secured in the open position at the bottom of the flexible hinges 13 via the use of holding mechanisms 21 rotated away from the pivot assembly 31 on their rotating hinges 54. One skilled in the art will understand that any other suitable holding mechanism 21 may be used such as clips, clamps, brackets, lockable hinges, U-shaped flute channel locks, tape, hook-and-loop or similar that temporarily secure the panel sections 11*a* . . . *n* in place.

In these respects, the extendable hand-held dry-erase sign 10 according to the present invention substantially departs from the limited concepts and designs of the prior art by providing an improved personal hand-held sign that can be more efficiently transported. Further, by providing a means to modify the sign as needed through the integration of a dry-erase board, the invention frees the user to update the sign as news and events quickly change. A consumer can use the dry-erase board more effectively and economically instead of purchasing limited use poster board that results in permanent text or cumbersome dry-erase boards as he or she would have to with the prior art.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. In all such cases, the result is a more aesthetically pleasing or customized for appearance or practical, functional purposes extendable hand-held dry-erase sign in a commercially manufacturable configuration that modifies the aesthetics and/or appearance while preserving the integrity and functional structure of the sign so as not to depart from established standards.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. For example, the telescoping support handle 12 may be replaced with a fixed-length static handle connected to the pivot assembly 31, resulting in a structure with a fixed length that pivots on the pivot assembly 31 to rest against the rear of the dry-erase board 11.

It is to be understood, therefore, that the invention may be practiced otherwise than as specifically set forth in the appended claims.

What is claimed is:

1. A deployable hand-held dry-erase sign comprising:

a dry-erase board further comprising a plurality of panel sections each configured with a dry-erase writing surface, all of said plurality of panel sections being pivotally joined together along parallel flexible hinges;

a pivot assembly attached to an edge of one of said plurality of panel sections; and an elongate support handle pivotally attached to said pivot assembly at one end.

2. The deployable hand-held dry-erase sign according to claim 1, further comprising a holding mechanism for maintaining said plurality of panel sections deployed in a planar configuration.

3. The deployable hand-held dry-erase sign according to claim 1, further comprising a handgrip attached to another end of said elongate support handle.

4. The deployable hand-held dry-erase sign according to claim 3, wherein said elongate support handle is extendable.

5. The deployable hand-held dry-erase sign according to claim 4, wherein said elongate support handle comprises a plurality of telescoping tubular sections.

6. The deployable hand-held dry-erase sign according to claim 4, wherein said dry-erase board is laminated on one wall with a dry erase laminate.

7. The deployable hand-held dry-erase sign according to claim 1, wherein said pivot assembly comprises a yoke having a pair of spaced collars protruding from a spine attached to said dry erase board, and a pin inserted through the yoke.

8. The deployable hand-held dry-erase sign according to claim 7, wherein said pin is tightenable by a locking knob to prevent pivoting.

9. The deployable hand-held dry-erase sign according to claim 7, further comprising a holding mechanism for wherein said pivot assembly comprises a yoke having a pair of spaced collars protruding from a spine attached to said dry erase board, and a pin inserted through the yoke.

10. The deployable hand-held dry-erase sign according to claim 9, wherein said holding mechanism further comprises a pair of arms pivotally attached to said spine.

11. The deployable hand-held dry-erase sign according to claim 10, wherein said holding mechanism further comprises a pair of detent fingers at each end of said pair of arms for clamping said flexible hinges.

12. The deployable hand-held dry-erase sign according to claim 1, wherein said dry-erase board is formed from a section of corrugated plastic twinwall sheet having one wall cut and another wall scored to define said plurality of panel sections.

13. The deployable hand-held dry-erase sign according to claim 1, further comprising a holding mechanism for wherein said pivot assembly comprises a yoke having a pair of spaced collars protruding from a spine attached to said dry erase board, and a pin inserted through the yoke.

14. The deployable hand-held dry-erase sign according to claim 13, wherein said holding mechanism further comprises detent fingers for clamping said flexible hinges.

15. A deployable hand-held dry-erase sign comprising:

a dry-erase board formed from a single section of corrugated twinwall plastic sheet having a rear face and a front face joined together by a plurality of conjoined ribs, said front face being scored and said rear face being conformingly cut to define a plurality of panel sections separated by flexible hinges and configured to be folded and unfolded accordion-style;

a pivot assembly attached to an edge of one of said plurality of panel sections; and an elongate support handle pivotally attached to said pivot assembly at one end.

16. The deployable hand-held dry-erase sign according to claim 15, further comprising a holding mechanism for maintaining said plurality of panel sections deployed in a planar configuration.

17. The deployable hand-held dry-erase sign according to claim 15, further comprising a handgrip attached to another end of said elongate support handle.

18. The deployable hand-held dry-erase sign according to claim 17, wherein said elongate support handle comprises a plurality of telescoping tubular sections.

19. The deployable hand-held dry-erase sign according to claim 15, wherein said pivot assembly comprises a yoke having a pair of spaced collars protruding from a spine attached to said dry erase board, and a pin inserted through the yoke.

20. The deployable hand-held dry-erase sign according to claim 15, further comprising a holding mechanism for clamping said flexible hinges.

* * * * *